United States Patent [19]

Pillot

[11] Patent Number: 4,569,556

[45] Date of Patent: Feb. 11, 1986

[54] ELEVATOR DEVICE FOR WHEELCHAIR AND WHEELCHAIR INCORPORATING SAME

[75] Inventor: Bernard Pillot, Romans, France

[73] Assignee: Société a Responsabilité Limitée International Diffusion Consommateur I.D.C, Bourg de Peage, France

[21] Appl. No.: 566,664

[22] Filed: Dec. 29, 1983

[51] Int. Cl.[4] ..... A61G 5/00

[52] U.S. Cl. ..... 297/316; 297/DIG. 10

[58] Field of Search ..... 297/316, DIG.10, DIG. 4, 297/330

[56] References Cited

U.S. PATENT DOCUMENTS

| | | | |
|---|---|---|---|
| 3,259,427 | 7/1966 | Wiest | 297/DIG. 10 |
| 3,640,566 | 2/1972 | Hodge | 297/DIG. 10 |
| 3,787,089 | 1/1974 | Wrethander | 297/DIG. 10 |
| 3,954,195 | 5/1976 | Deuchar | 297/316 |
| 4,076,304 | 2/1978 | Deucher | 297/DIG. 10 |
| 4,231,614 | 11/1980 | Shaffer | 297/DIG. 4 |
| 4,456,086 | 6/1984 | Wier et al. | 297/DIG. 4 |

*Primary Examiner*—Francis K. Zugel

*Attorney, Agent, or Firm*—Bacon & Thomas

[57] ABSTRACT

The invention is concerned with assistance to handicapped persons. The device according to the invention is in the form of an articulated structure comprising two symmetrical lateral systems each comprising a first deformable quadrilateral, a second deformable quadrilateral, a trilateral, an elastic member and a manoeuvring assembly. The invention is applicable to wheelchairs for handicapped persons or invalids.

16 Claims, 4 Drawing Figures

ELEVATOR DEVICE FOR WHEELCHAIR AND WHEELCHAIR INCORPORATING SAME

The invention relates to wheelchairs used by handicapped persons and invalids, and is equally well applicable to folding or non-folding wheelchairs.

It is an incontestable fact that wheelchairs have given handicapped persons and invalids the possibility of mobility. However, these wheelchairs present several drawbacks due to the users being able to occupy only one sitting position in which they generally remain for relatively long periods of time.

Firstly, the sole sitting position which may be adopted does not allow readaptation to normal living conditions and does not facilitate social contacts.

Secondly, this sitting position maintained for long periods of time is responsible for physical degradation such as loss of angular amplitude of the lower limbs, poor blood circulation, slowing down of the digestive and intestinal functions, fragility of the bones, etc . . . .

In an attempt to overcome the above drawbacks, different propositions have already been put forward.

A first proposition has been to provide the frame of a wheelchair with an articulated structure comprising a back, a seat and a footrest. Such a structure is mounted to pivot by the seat on a front horizontal axis, perpendicular to the vertical plane of symmetry of the frame. In such an embodiment, a jack incorporating an electric motor is interposed between the frame and the structure and, more generally, the seat, so as to be able to control the raising or lowering of the articulated structure.

Such a solution involves a source of energy borne by the wheelchair and poses problems of safety, reliability, price and weight, by reason of the use of electrical energy. These different problems render practical application difficult, if not impossible.

Another proposition has been to mount on the frame of a wheelchair a seat pivoting on a front horizontal axis. A hydraulic pump, controlled manually, supplies a hydraulic jack interposed between such a seat and the frame.

Such a solution is, in fact, of interest only when a handicapped person using a supporting appliance of the orthosis type is to be transferred from a sitting position to a standing position and vice versa. Such a solution therefore cannot solve the problem raised, that of offering the possibility for a handicapped person to occupy a sitting position or a stable pseudo-vertical position in complete safety.

A third known solution has been to propose the adaptation on the two lateral sides of a wheelchair of two articulated systems fixed to the pivoting armrests. Means are provided for maintaining the two systems laterally and to the rear when the wheelchair is used normally. The means provided are also designed so as to allow the two articulated systems to be folded down forwardly, in which case they may be connected by a front bar on which the patient may exert a traction by his arms to find assistance for rising.

The two articulated systems are generally designed to form a sort of cage, in association with the front bar, such a cage being completed by the existance of pivoting stops which may represent a back or bottom support for the patient occupying the standing position.

Such a solution seems to respond to the general problem posed, but leads to a device which is long to place in position or possibly to retract after use. In addition, such a device is little used in practice as it does not offer the patient the possibility of making frequent transitions from sitting position to standing position, and vice versa, rapidly, easily and without great fatigue.

Furthermore, the technical means retained form a cumbersome assembly rendering the wheelchair unusable in numerous practical cases, whenever the ground surface or the volume of access is reduced.

Moreover, such a system can really be used only by a handicapped person or invalid capable of developing considerable muscular work and of finding a possibility of blocking the joints when the standing position has been attained.

It is an object of the invention to provide a real, practical solution to the problem set forth above, by proposing a simple, robust, adjustable device offering certain security and reliability, even when subjected to intensive use.

The object of the invention is designed so as to eliminate any auxiliary or additional energy supply and to be able to be used virtually by any handicapped person, whatever his age and the physical power that he can develop.

It is another object of the invention to offer means of small dimensions which may be provided at manufacture on wheelchairs especially designed to this end or adapted to equip wheelchairs of conventional design, whether such wheelchairs are of rigid or foldable structure.

It is a further object of the invention to propose a novel device for adjusting, with precision, the different parameters having to be considered to effect transition from the sitting position to the standing position, taking into account the morphology, size and weight of each patient.

To attain the objectives set forth hereinabove, the object of the invention is characterized in that it is in the form of an articulated structure constituted by two articulated systems symmetrical with respect to a vertical plane of symmetry, intended to be adapted laterally on the frame of a wheelchair and connected together by a back, a seat and a footrest, each articulated system comprising:

a first deformable quadrilateral intended to be mounted pivotally on the substantially front part of a wheelchair frame corresponding to the seat in order to contribute to the support of a seat, a second deformable quadrilateral articulated partly on the first and partly on the frame in order to contribute to the support of a footrest, a trilateral articulated on the first quadrilateral opposite the second in order to contribute to the support of a back, an elastic member adapted to be interposed between the first quadrilateral and the frame, and a manoeuvring assembly adapted to be disposed between the first quadrilateral and the frame in order to perform a function of manual control and monitoring of the relative pivoting of said system with respect to the frame and a function of stop and locking of said system in a lowered or elevated position of the structure.

The invention also relates to a wheelchair comprising an elevator device according to the invention.

The invention will be more readily understood on reading the following description with reference to the accompanying drawings, in which.

Figure 1:
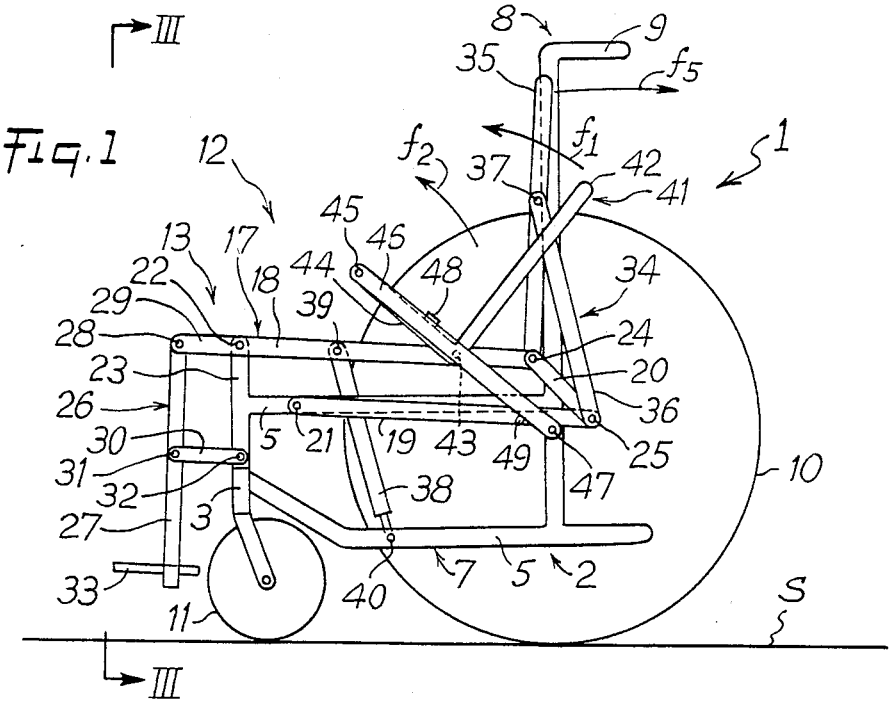
FIG. 1 is a side elevation schematically showing a wheelchair for a handicapped person or invalid, equipped with a device according to the invention.
Figure 2:
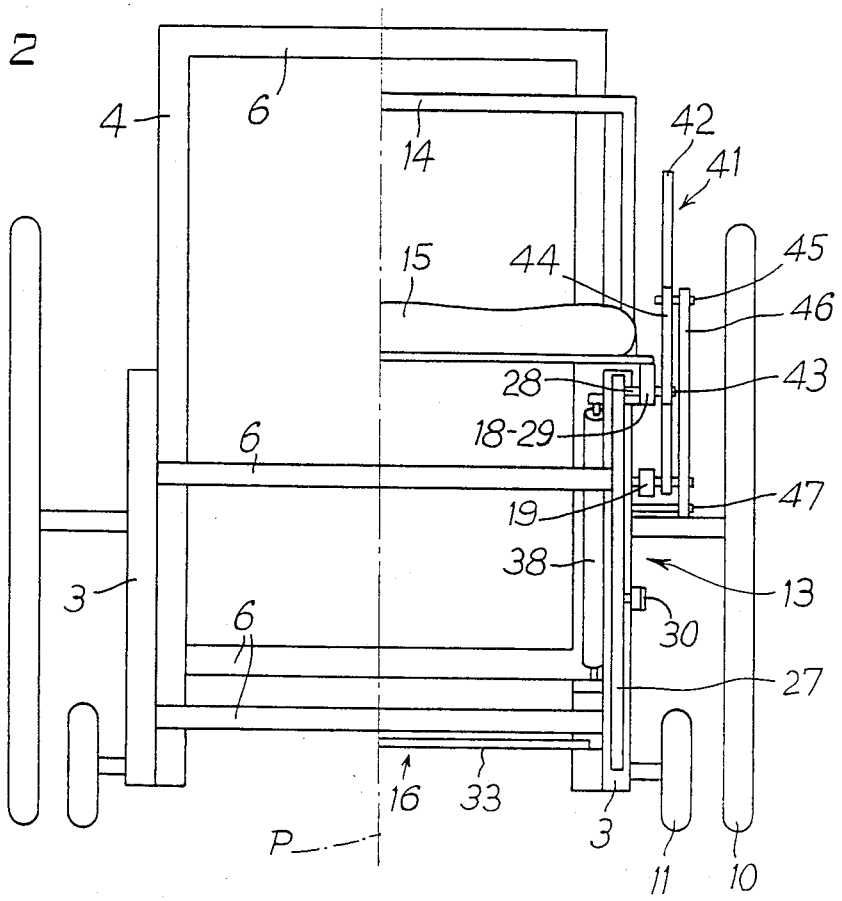
FIG. 2 is a front view, on a different scale, taken along line II—II of FIG. 1.

Referring now to the drawings, FIGS. 1 and 2 schematically show a wheelchair 1 comprising a frame 2 constituted by front uprights 3 and rear uprights 4 connected together by sills 5 and crosspieces 6. These different constituent elements define a seat bearing reinforcement 7 and a back bearing reinforcement 8 in the upper part of which handles 9 may be provided to facilitate displacement of the wheelchair for a person assisting the handicapped person.

The frame 2 is provided, in manner known per se, with bearing and driving wheels 10 and with swivelling guiding wheels 11.

The above frame 2 corresponds to a wheelchair of rigid design, but it is obvious that a substantially similar form is retained for a foldable wheelchair. In fact, in such a case, the rigid elements forming the crosspieces 6 are replaced by folding elements of design known per se.

The above-described frame 2 is equipped, according to the invention, with an elevator device in the form of an articulated structure 12 borne by the frame 2. The articulated structure is constituted by two articulated systems 13 symmetrical with respect to a vertical plane of symmetry P of the wheelchair or the bearing frame 2. Each articulated system 13 is intended to be adapted laterally on the frame 2 and is connected to the homologous system 13 by a back element 14, seat element 15 and footrest element 16. These different elements are, in the example illustrated, formed by rigid structures, but it is obvious that a different embodiment may be adopted in the event of such elements also having to comply with the imperative of folding in concomitance with such possibility offered by the bearing frame 2.

Each articulated system 13 comprises a first deformable quadrilateral 17 constituted by two bars 18 and 19 joined at their ends located near the back reinforcement 8, by a spacer bar 20. The quadrilateral 17 is adapted to be disposed laterally, for example outside the corresponding lateral side of the frame 2, so that the bars 18 and 19 are substantially superposed.

The quadrilateral 17 is mounted on the seat reinforcement 7 by a first point of articulation 21 provided between the front free end of the lower bar 19 and, for example, the upper sill 5. A second point of articulation 22 is provided between the upper bar 18 and the seat reinforcement 7, so that the geometrical axis of this point is substantially located in upper front position of said reinforcement 7. In the example illustrated, the point of articulation 22 is borne by an extension 23 formed by the corresponding front upright 3. In the case illustrated, the distance separating the points of articulation 21 and 22 and that between the points 24 and 25 joining the bar 20 to the bars 18 and 19, are equal and give the quadrilateral 17 a privileged form of parallelogram.

A desired deformation of such a quadrilateral may be envisaged with a view to adapting its characteristics as a function of the morphology of the patients. In this respect, it may be provided to render the point of articulation 21 adjustable forwardly or rearwardly in the horizontal plane of the bearing frame 2.

Each articulated system 13 further comprises a second deformable quadrilateral 26 which is disposed on the frame 2, substantially in front of the seat reinforcement 7. Quadrilateral 26 comprises a jamb 27 connected by a point of articulation 28 to an extension 29 of the bar 18 beyond the point of articulation 22. The extension 29 constitutes one of the sides of the quadrilateral 26. The jamb 27 is joined to the corresponding front upright 3 by a spacer bar 30 articulated on points 31 and 32. The spacer bar 30 represents the third side of quadrilateral 26 of which the fourth is formed by that part of the upright 3 included between points of articulation 22 and 32.

The jamb 27 extends substantially below the point of articulation 31 and supports a footrest 33 in cooperation with the jamb 27 of the homologous articulated system. Although this has not been shown, the means for connection between the footrest 33 and the jamb 27 are provided to allow adjustment in height and relative orientation.

The point of articulation 28 is preferably adjustable so that the practical length of the extension 29 can be modified and the inclination of the jamb 27 can be adapted as a function of the patient's morphology.

Each articulated system 13 further comprises an articulated trilateral 34 constituted by an upright 35 mounted pivotally on pin 24. Trilateral 34 is composed of upright 35, the spacer bar 20 and a triangulation bar 36 articulated on the one hand on pin 25 and on the other hand on a pin 27 borne by the upright 35. The position of pin 37 on the upright 35 is preferably adjustable so as to allow possible adjustment of the angle formed by the upright with respect to the bar 18.

Each articulated system 13 also comprises an elastic member 38 interposed between the deformable quadrilateral 17 and the frame 2. The elastic member 38 is interposed between the upper bar 18 and the lower sill 5, being adapted on these elements by points of articulation 39 and 40 which are preferably adjustable in position forwardly or rearwardly of the frame 2. The elastic member 38 is designed to perform a function of compensation of weight and energy absorption, as well as a function of restitution, as will appear hereinafter. The elastic member 38 may be constituted by a compensating spring or, preferably according to the invention, by a jack of the gas actuated type, advantageously provided with a valve for adjusting the transfer of its fluid. FIG. 2 shows that the elastic member 38 is preferably placed inside the seat reinforcement 7 of the frame 2.

Each articulated system 13 further comprises a manoeuvring member 41 intended to perform a function of manual control of the relative pivoting of the articulated system 13 with respect to the frame and a function of stop and locking of said system in a position of maximum lowering corresponding to the sitting position, as shown in FIG. 1, or in a position of elevation as will follow from the following. To this end, the manoeuvring assembly 41 comprises a lever 42 mounted pivotally by a point 43 on the first quadrilateral 17 and preferably on the upper bar 18. The lever 42 is extended by an angle arm 44 extending towards the front part of the frame 2 and joined by an articulation 45 to a connecting rod 46 mounted by a point of articulation 47 on the frame 2. The elements constituting the assembly 41 are disposed laterally and externally with respect to the articulated system 13, as shown in FIG. 2.

FIG. 1 shows that the assembly 41 is designed so that, in a position of maximum lowering corresponding substantially to the sitting position, the pivot pin 43 is disposed below the fictitious line passing through the points of articulation 45 and 47. This results in a geometrical locking which opposes any untimely pivoting of the lever 42 in the direction of arrow $f_1$. The function of locking is completed by a function of stop determining the sitting position. This stop function is for example performed by a catch 48 or the like borne by the arm 44 and under which the connecting rod 46 abuts in the position illustrated in the drawing. This stop may be principal or preferably secondary, intervening in combination with a damper placed between the quadrilateral 17 and the seat reinforcement 7.

As stated previously, the two articulated systems 13 are connected by back, seat and footrest elements which are designed to establish a conjugation of their relative displacement and form therewith the articulated structure 12.

In the state illustrated in FIG. 1, the structure 12 occupies a position of maximum lowering with stop and locking and the wheelchair then performs the function of seat for a patient occupying the seat, back and footrest. In this position, the elastic members 38 are compressed.

When the patient wishes to be transferred from sitting position to a pseudo-vertical position, he acts on levers 42, pivoting them in the direction of arrow $f_1$, so as to pass the points of articulation 43 beyond the alignment of points 45 and 47 and thus to break the lateral geometrical lockings established by the assemblies 41. The levers 42 may thus pivot on points 43, abutting by points 45 on the connecting rods 46. This results in the combined elevation of points 43 which controls pivoting of the quadrilaterals 17 in the direction of arrow $f_2$ on points 21–22. This pivoting, once started by action on levers 42, is taken over, assisted or maintained, depending on the adjustments made, by the elastic members 38 which restitute the energy previously stored.

In this way, the patient is progressively raised by the pivoting of the quadrilaterals 17 of the articulated systems 13, whilst having the possibility of controlling this pivoting movement by a retaining action on the levers 42, insofar as the action of restitution of the elastic members 38 is sufficient to take over pivoting of the structure 12 after unlocking by manual action on the levers 42.

By the pivoting of the deformable quadrilaterals 17, the trilaterals 34 are raised and maintain the uprights 35 substantially in their initial orientation. This results in a progressive opening of the angle formed between the seat and back planes.

Simultaneously, the downward pivoting of the extensions 29 subjects the quadrilaterals 26 to a corresponding deformation tending to lower the footrest 33. The jambs 27 are of such length that, as a function of the adjustment made to point 28, they abut on the ground when the structure 12 occupies the position of maximum elevation shown in FIG. 3. This position is attained, determined and locked via the two assemblies 41. In fact, the relative pivoting in the direction of arrow $f_1$ of the levers 42 and the corresponding relative pivoting of the two quadrilaterals 17 have for their effect to bring points 45 beyond the alignment of the points of articulation 43.

This results in a geometrical locking in a stable position of elevation, determined by the abutment of arms 44 against stops 49 borne for example by the lower bars 19 of the deformable quadrilaterals 17.

Figure 3:
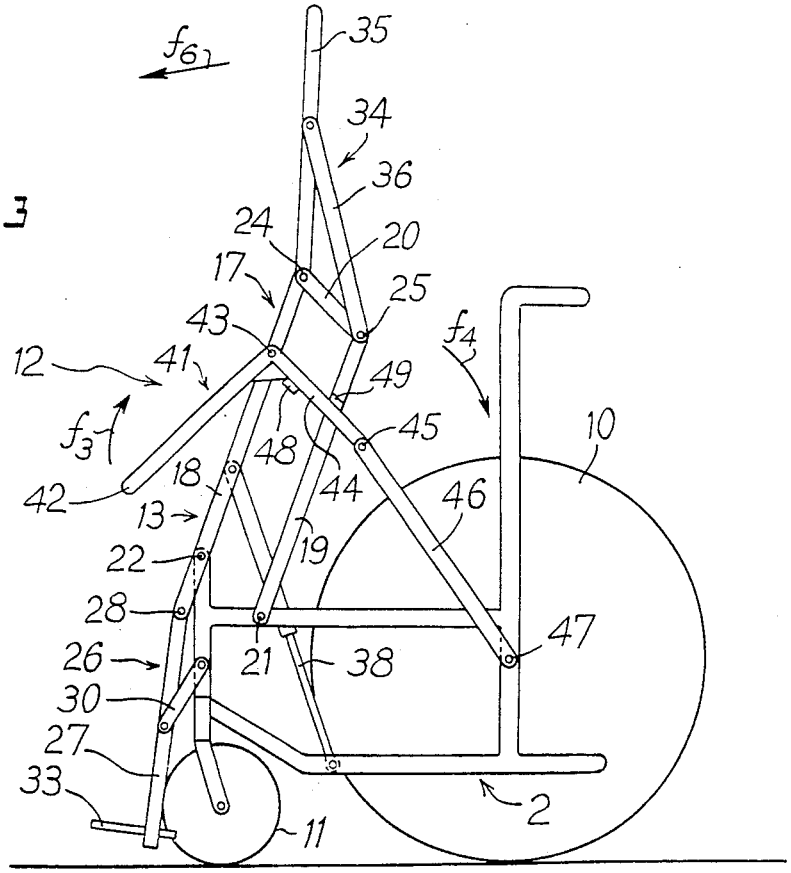
FIG. 3 is a schematic view, similar to FIG. 1, but illustrating a second position characteristic of a wheelchair incorporating the device of the invention.

The above means consequently make it possible to maintain the structure 12 in a position of elevation, as illustrated in FIG. 3, in which it represents a continuous plane of support and hold for a patient maintained in a virtually standing posture, bearing by his feet on the footrest 33.

Stable restraint of the patient may be ensured if necessary by straps passing around the legs and the torso.

When the patient wishes to control the reverse transition towards the stable sitting position, he acts on levers 42 in the direction of arrow $f_3$ so as to break the geometrical lock allowing rotation of the levers on the points of articulation 43. By effect of traction exerted on the connecting rods 46, the rotation of levers 42 is translated by a pivoting of the two deformable parallelograms 17 in the direction of arrow $f_4$ and by a concomitant displacement of the quadrilaterals 26 and the trilaterals 34.

When this movement is started, the weight of the reinforcement 12 and of the patient is responsible for the compression of the springs 38 which store the restitution energy as the articulated structure 12 pivots in return towards its lower position.

The elastic members 38 are provided to offer a certain resistance to such a compression, so as to effect a compensation of the weights supported and to avoid a rapid return to the stable position of maximum lowering. As before, levers 42 make it possible to control, if necessary, the pivoting of structure 12 towards this position of maximum lowering.

Adjustment of the relative position and of the reaction of compression opposed by the elastic members 38 are in practice determined so as to obtain, for a patient of given weight, a slow, progressive return from the position of maximum elevation to the position of maximum lowering. In such a case of adjustment, the reverse pivoting involves a weak but constant action on the levers 42 so as to apply an additional force capable of overcoming the frictions created by the pivoting of the different elements constituting the articulated structure 12 and of being added to the work of the elastic members 38.

As is seen from the foregoing, the means according to the invention are simple, inexpensive, reliable and robust and make it possible, without additional outside energy, to control a transfer from a position of maximum lowering to a position of maximum elevation, and vice versa, of the articulated structure 12 ensuring either the support of a patient in sitting position, or the maintenance of the patient in a virtually standing posture.

The means of the invention offer noteworthy stability in the position of maximum elevation, since the articulated structure 12, in extended position, finds additional support on the ground via the jambs 27 which increase the bearing surface determined by the points of contact between the ground S and the wheels 10 and 11.

It should be noted that the particular form of the manoeuvring assemblies 41 is also chosen so that the levers 42 represent, in the position of maximum elevation, as illustrated in FIG. 3, lateral elements capable of contributing to a transverse wedging of the patient's body, if necessary.

Figure 4:
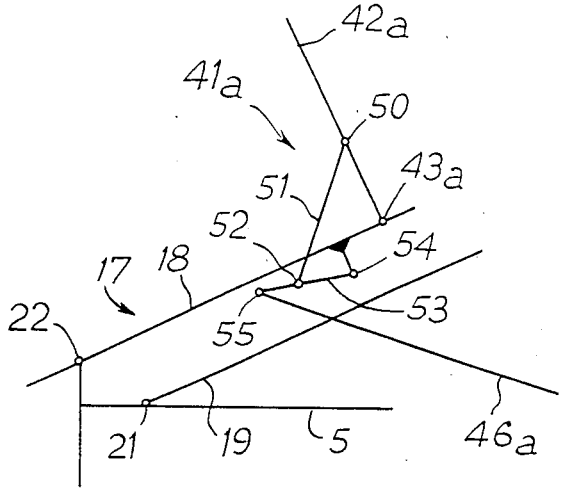
FIG. 4 is a schematic view showing a variant embodiment of one of the elements constituting the object of the invention.

In certain cases, each manoeuvring assembly 41 may be provided with means for multiplying the amplitude of displacement, so as to reduce the amplitude of pivoting of lever 42. In that case, each assembly 41 comprises, as illustrated in FIG. 4, a lever 42*a* articulated directly by point 43*a* on the deformable quadrilateral 17. Lever 42*a* is associated by a point of articulation 50 with an arm 51 which is articulated by a point 52 on a crank 53 itself articulated on a point 54 borne by the deformable quadrilateral 17. The end of crank 53, opposite the point of articulation 54, is joined by an articulation 55 to connecting rod 46*a*.

Assemblies 41*a* function in similar manner to what is described above and perform the same functions for a lower amplitude of angular pivoting of the levers 42*a*.

The means of the invention make it possible to effect a rapid transfer of position, without using a great deal of physical energy, and may thus be used relatively frequently by a patient wishing to adopt an upright position to facilitate his general activity and for carrying out ordinary tasks, or wishing to change his position so as to favour maintaining more suitable physical conditions.

Another advantage of the object of the invention lies in the fact that the means used are of particularly small dimensions and are included within the maximum volume of an ordinary wheelchair.

Another important advantage of the object of the invention lies in the fact that the technical means recommended make it possible to constitute an elevator device representing a structure easily adapted on a wheelchair of ordinary type, on the frame of which the necessary points of articulation are added.

It thus becomes possible to envisage marketing the elevator device alone and to fit it on wheelchairs of conventional design, or to envisage producing wheelchairs fitted at manufacture with a device according to the invention.

In this respect, the invention therefore relates to an elevator device in the general sense and to a wheelchair, of any design, comprising such a device.

Another important advantage of the invention resides in that the physical energy spent by the action of the arms on the levers 42 may be reduced by using to advantage the action of the body and, more particularly, of the torso on the back part of the structure 12. In fact, insofar as a strap connects the patient's torso to the back, a thrust action in the direction of arrow $f_5$ (FIG. 1) has for its effect to stress the trilaterals 34 which then tend to provoke pivoting of the quadrilaterals 17 in the direction of arrow $f_2$. Such an action therefore contributes to reducing the force exerted on the levers 42.

A traction exerted in the direction of arrow $f_6$, from the position according to FIG. 3, produces a similar aid for returning the structure 12 into sitting position.

The invention is not limited to the examples described and shown, as various modifications may be made thereto without departing from the scope thereof.

What is claimed is:

1. An elevator device for a chair structure having a frame, and a seat, a backrest, and a footrest, movable between a first, sitting position and a second, standing position, the elevator device comprising:

(a) a first quadrilateral link mechanism attached to each side of the seat and pivotally attached to the frame;

(b) a second quadrilateral link mechanism attached to each side of the footrest and attached to the first quadrilateral link mechanism and pivotally attached to the frame;

(c) a trilateral link mechanism attached to each side of the backrest and pivotally attached to the first quadrilateral link mechanism;

(d) manually operable maneuvering linkages located on each side of the chair structure, each comprising:

(i) a lever pivotally attached to the first quadrilateral link mechanism at a first pivot point;

(ii) a rod; and, (iii) first means pivotally connecting the rod to the lever at a second pivot point and second means pivotally connecting the rod to the frame at a third pivot point, such that in the first, sitting position, the first pivot point is below a line passing through the second and third pivot points and, in the second, standing position, the second pivot point is above a line passing through the first and third pivot points so as to form an over-center locking mechanism in each position; and (e) an elastic member interposed between the first quadrilateral link mechanism and the frame to counterbalance the weight of the user during movement between the sitting and standing positions.

2. The elevator device according to claim 1 further comprising a stop catch attached to the lever so as to contact the rod to limit the lowering motion of the device and define the first, sitting position.

3. The elevator device according to claim 1 wherein the lever comprises first and second lever arms, the first pivot point located at the juncture of the lever arms and the second pivot point being located adjacent the distal end of the second lever arm.

4. The elevator device according to claim 3 wherein the first and second lever arms are disposed at approximately 90° from each other.

5. The elevator device according to claim 3 further comprising a first stop catch attached to the second lever arm so as to contact the rod to limit the lowering motion of the device and define the first, sitting position.

6. The elevator device according to claim 5 further comprising a second stop catch attached to the first quadrilateral link mechanism so as to contact the second lever arm to limit the raising motion of the device and define the second, standing position.

7. The elevator device according to claim 1 wherein the elastic member comprises a gas actuated jack.

8. The elevator device according to claim 1 wherein the first means connecting the rod to the lever multiplies the amplitude of displacement of first quadrilateral link mechanism.

9. A wheelchair for an invalid or handicapped person comprising:

(a) a frame;

(b) a plurality of wheels rotatably attached to the frame;

(c) a seat;

(d) a backrest;

(e) a footrest;

(f) a first quadrilateral link mechanism attached to each side of the seat and pivotally attached to the frame;

(g) a second quadrilateral link mechanism attached to each side of the footrest and attached to the first quadrilateral link mechanism and pivotally attached to the frame;

(h) a trilateral link mechanism attached to each side of the backrest and pivotally attached to the first quadrilateral link mechanism;

(i) manually operable maneuvering linkages located on each side of the wheelchair, each comprising:

(i) a lever pivotally attached to the first quadrilateral link mechanism at a first pivot point;

(ii) a rod; and, (iii) first means pivotally connecting the rod to the lever at a second pivot point and second means pivotally connecting the rod to the frame at a third pivot point, such that in the first, sitting position, the first pivot point is below a line passing through the second and third pivot points and, in the second, standing position, the second pivot point is above the line passing through the first and third pivot points so as to form an over-center locking mechanism in each position; and, (j) an elastic member interposed between the first quadrilateral link mechanism and the frame to counterbalance the weight of the user during movement between the sitting and standing positions.

10. The wheelchair according to claim 9 further comprising a stop catch attached to the lever so as to contact the rod to limit the lowering motion of the device and define the first, sitting position.

11. The wheelchair according to claim 9 wherein the lever comprises first and second lever arms, the first pivot point located at the juncture of the lever arms and the second pivot point being located adjacent the distal end of the second lever arm.

12. The wheelchair according to claim 11 wherein the first and second lever arms are disposed at approximately 90° from each other.

13. The wheelchair according to claim 11 further comprising a first stop catch attached to the second lever arm so as to contact the rod to limit the lowering motion of the device and define the first, sitting position.

14. The wheelchair according to claim 13 further comprising a second stop catch attached to the first quadrilateral link mechanism so as to contact the second lever arm to limit the raising motion of the device and define the second, standing position.

15. The wheelchair according to claim 9 wherein the elastic member comprises a gas actuated jack.

16. The elevator device according to claim 9 wherein the first means connecting the rod to the lever multiplies the amplitude of displacement of first quadrilateral link mechanism.

* * * * *